United States Patent [19]

Petermann

[11] 4,132,752

[45] Jan. 2, 1979

[54] APPARATUS FOR PROVIDING A UNIFORM COMBUSTIBLE AIR-FUEL MIXTURE

[75] Inventor: Walter E. Petermann, Caracas, Venezuela

[73] Assignee: Carbo-Economy, S.A., Caracas, Venezuela

[21] Appl. No.: 884,008

[22] Filed: Mar. 6, 1978

Related U.S. Application Data

[63] Continuation-in-part of Ser. No. 815,541, Jul. 14, 1977, Pat. No. 4,087,493, which is a continuation of Ser. No. 589,897, Jun. 24, 1975, abandoned.

[51] Int. Cl.[2] ..... F02M 9/12

[52] U.S. Cl. ..... 261/40; 261/121 A; 261/44 D; 261/DIG. 39; 261/121 B

[58] Field of Search ..... 261/40, 121 B, 121 A, 261/44 D, DIG. 39

[56] References Cited

U.S. PATENT DOCUMENTS

| | | | |
|---|---|---|---|
| 1,163,581 | 12/1915 | Alley | 261/40 |
| 1,441,992 | 1/1923 | Meden | 261/44 D |
| 1,594,682 | 8/1926 | Morton | 261/40 |
| 1,721,618 | 7/1929 | Ensign | 261/121 A |
| 2,012,665 | 8/1935 | Gustafsson | 261/121 A |
| 2,167,892 | 8/1939 | Kent et al. | 261/44 D |
| 3,265,374 | 8/1966 | Morton | 261/50 A |
| 4,007,721 | 2/1977 | Requeiro | 261/121 B |
| 4,080,409 | 3/1978 | Graybill | 261/121 B |
| 4,088,715 | 5/1978 | Graybill | 261/121 B |

FOREIGN PATENT DOCUMENTS

| | | | |
|---|---|---|---|
| 208586 | 2/1977 | Argentina | 261/40 |
| 457923 | 3/1928 | Fed. Rep. of Germany | 261/121 A |
| 216913 | 6/1924 | United Kingdom | 261/121 A |

*Primary Examiner*—Tim R. Miles

*Attorney, Agent, or Firm*—Brumbaugh, Graves, Donohue & Raymond

[57] ABSTRACT

A carburetor for gasoline internal combustion engines includes a generally cylindrical housing having an intake air receiving section. A fuel atomization and distribution device is mounted in the housing immediately below the intake air receiving section. It comprises an upper ring-like insert having twelve equally spaced openings extending through the ring to form auxiliary air bleeds for the carburetor. Mounted beneath the upper insert is a second ring-like insert comprising a generally annular outside wall, a conically-shaped interior wall and a generally annular top wall. The outside wall includes a tapered section that forms the fuel distribution channel for the carburetor. Twelve generally rectangularly shaped fuel supply channels are formed in the top wall of the insert in alignment with the openings formed in the first insert and in communication with the tapered section.

Within the carburetor a regulating member is mounted for longitudinal movement. It is in the configuraion of two generally frusto-conical sections with the bases of the two sections arranged end-to-end. The upper section has a taper angle which is the same as the angle of divergence of the inside wall of the lower insert and forms therewith a constricted zone wherein atomization of the liquid fuel takes place. The lower section of the regulating member provides, together with the interior wall of the housing, an expansion area through which the atomized liquid fuel-air mixture passes before being supplied to the engine manifold.

Finally, a variable air bleed device supplies a variable amount of air to the fuel supply passage that communicates with the fuel distribution channel formed in the second insert. The variable air bleed device causes the initial atomization of the liquid fuel before the fuel is supplied to the fuel distribution channel.

9 Claims, 12 Drawing Figures

10
12
14
15
18
20
22
24
24a
24b
26
32
34
36
38
40
42
44
46
48
50
58
60
62
70
5

APPARATUS FOR PROVIDING A UNIFORM COMBUSTIBLE AIR-FUEL MIXTURE

BACKGROUND OF THE INVENTION

This is a continuation-in-part application of my application Ser. No. 815,541, filed July 14, 1977, now U.S. Pat. No. 4,087,493, entitled "Apparatus for Providing a Uniform Combustible Air-Fuel Mixture" which, in turn, is a continuation of application Ser. No. 589,897 of the same title filed June 24, 1975, now abandoned. Foreign counterpart applications of application Ser. No. 589,897 have issued more than a year prior to the date of this application.

This invention relates to carburetors for internal combustion engines and, more particularly, to a new and improved carburetor which provides a uniform combustible atomized liquid fuel and air mixture to the cylinders of a gasoline internal combustion engine.

The carburetor of application Ser. No. 815,541 represents a dramatic step in improving the mixing between the liquid fuel and the intake air drawn through the carburetor and developing a uniform mix of air and liquid fuel over the full range of operating conditions of the engine. Generally, that carburetor includes a generally cylindrical housing within which a regulating member in the configuration of upper and lower cone-like sections reciprocate in accordance with engine speed. The mixing chamber includes a radial wall defining an opening of predetermined diameter within the carburetor housing, converging and diverging walls that meet at a sharp edge and define the smallest opening within the carburetor housing and liquid fuel supply ports which supply liquid fuel into the intake air immediately below the sharp edge. The upper cone-like section of the regulating member and the diverging wall of the mixing chamber define a gradually enlarging constricted zone wherein the liquid fuel is mixed with and atomized by the intake air. This mixture is then passed through a turbulence zone formed by the lower cone-like section of the regulating member and to the cylinders of the engine.

Tests performed on the applicant's carburetor demonstrated its significant potential. In a 505 EPA variable speed test conducted on a 1975 Hornet equipped with the carburetor, the car emitted 0.19 grams of hydrocarbon per vehicle mile, 1.89 grams of carbon monoxide per vehicle mile and 1.86 grams of oxide of nitrogen per vehicle mile. However, in other 505 tests, the exhaust emissions of all three pollutants were considerably higher.

SUMMARY OF THE INVENTION

It is an object of the present invention to provide a new and improved carburetor that provides a virtual completely atomized liquid fuel-air mixture to the cylinders of an internal combustion engine under all operating conditions.

It is another object of the present invention to provide a new and improved carburetor which reduces significantly the emission of pollutants over a full range of operating conditions of the engine.

It is still another object of the present invention to provide a new and improved carburetor wherein preatomization of the liquid fuel takes place before the liquid fuel is drawn into the main stream of air passing through the carburetor housing.

These and other objects of the invention are accomplished by a carburetor comprising a generally cylindrical housing having an intake air receiving section in the form of an opening of predetermined diameter and length, a mixing chamber in the form of an opening smaller in diameter than the intake air receiving section, and an outlet section, liquid fuel supply means that supplies fuel to the mixing chamber, a fuel atomization and distribution device mounted in the mixing chamber and including upper and lower ring-shaped sections that define an opening of minimum diameter within the housing. The upper section has formed therethrough a plurality of circumferentially-spaced openings which function as air bleeds. The lower section has an annular outside wall that communicates with the liquid fuel supply means and constitutes a fuel distribution channel, a generally conically shaped interior wall and an upper wall that includes a plurality of fuel supply channels that communicate with the fuel distribution channel and are aligned with and correspond in number to the air bleed openings formed in the upper section.

The carburetor further comprises a regulating member mounted for reciprocating movement within at least the mixing chamber. It is in the configuration of two frusto-conical sections, with the upper section thereof having a conical angle which is substantially the same as the conical angle of the interior wall of the lower section of the fuel atomization and distribution device.

Coupled to the liquid fuel supply means is a variable air bleed control means which supplies a variable amount of air to the liquid fuel supply means before the liquid fuel is passed to the fuel distribution channel. The air supplied from the variable air bleed means mixes with and atomizes the liquid fuel before the fuel is supplied to the fuel distribution channel.

DESCRIPTION OF THE PREFERRED EMBODIMENT

Figures 1, 1A:
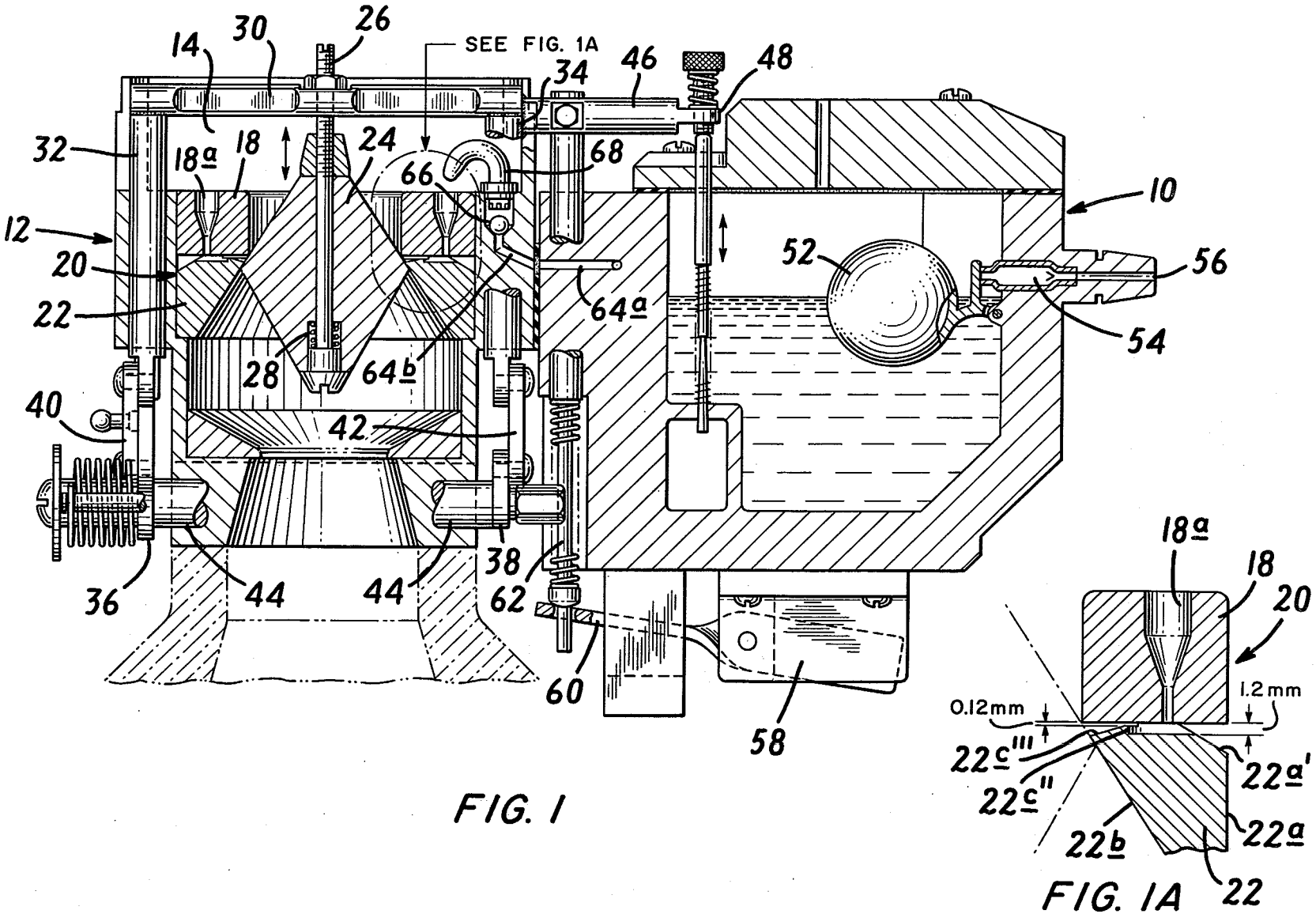
FIG. 1 is a sectional view of a carburetor for use with a gasoline internal combustion engine arranged according to the present invention.
FIG. 1A is an enlargement showing a section of the fuel atomization and distribution device mounted in the carburetor of the present invention.

In the preferred embodiment of the invention, as shown in FIGS. 1–10, the invention is adapted for use as a carburetor in a gasoline internal combustion engine. The carburetor consists generally of two principal units, a float-controlled fuel reservoir 10 whose structure and operation are conventional, and the principal housing for the carburetor 12 whose structure and operation constitute the applicant's invention.

As constructed in actual practice, the generally cylindrical housing 12 has an inside diameter of about 2½ inches. The housing comprises an intake air receiving section 14 formed by the wall 15 of the housing. Below the upper section the thickness of the housing wall is increased so as to form a second opening in the housing smaller in diameter than the opening of the intake air receiving section 14.

Mounted within the second opening is a first ring-like insert 18 that defines an opening of minimum aperture and comprises one-half of an air fuel atomization and distribution device 20. The insert 18, preferably having a height of about 14 millimeters, includes twelve equally spaced openings **18*a* mounted centrally within the annular wall of the insert and extending through the insert. As best shown in FIG. 1A, each of the openings includes a first cylindrical section, preferably having a diameter of 5 millimeters through which the intake air passes first, a second tapered section and a second short cylindrical section having a predetermined diameter, preferably 1 to 1.2 millimeters. The twelve openings 18*a* form auxiliary air bleeds for the carburetor insofar as air drawn through the carburetor will pass through the openings and, with increased velocity due to the configuration of the openings, impinge upon and reduce the atomized liquid fuel as supplied to the carburetor immediately below the openings 18*a*** as hereinafter described, into a micronized thin film of liquid.

A second ring-like insert 22 is mounted beneath and is contiguous with the first insert 18 and forms the other half of the fuel atomization and distribution device 20 of this invention. Beneath the thickened portion of the housing wall, the wall extends radially inwardly a short distance to provide a supporting wall for the inserts 18 and 22. The insert 22 has an outside diameter equal to that of the first insert. It comprises a generally annular outside wall **22*a*, a conically shaped interior wall 22*b* and a generally annular top wall 22*c*. The outside wall includes a section 22*a*′ that tapers inwardly to the top wall 22*c* and forms the fuel distribution channel for the carburetor. An atomized liquid fuel mixture is supplied tangentially into the channel 22*a*′ and will be swept completely around the channel. A stop 22*d* is also provided in the insert 22** to insure that the atomized fuel mixture supplied to the channel is swept around the insert in one direction.

Formed in the top wall **22*c* of the insert and communicating with the distribution channel are a plurality of generally rectangularly shaped fuel supply channels or slots 22*c*′ that are aligned with the openings 18*a* formed in the first insert 18. The slots preferably have a depth of 1.2 millimeters. Adjacent the inside ends of the slots there is formed in the top wall an annular depression 22*c*″ having a depth of 0.12 millimeters or one-tenth the depth of the channels. From the depression 22*c*″ the top wall has a sloping wall 22*c*‴ that extends downwardly to the conically shaped interior wall 22*b*. The depression 22*c*″ and the sloping wall 22*c*‴ provide an opening between the inserts 18 and 22 wherein air drawn through the carburetor mixes with and atomizes the already atomized fuel supplied to the slots 22*c*′**.

The air-fuel atomization and distribution device 20 is shown as comprising upper and lower inserts 18 and 22. It will be understood, of course, that the device may be of one-part construction without affecting in any way the operation of the device.

In operation, air is drawn through the opening of minimum housing diameter formed by the inserts 18 and 22. Air also is drawn through the twelve openings **18*a* formed in the upper insert and is directed downwardly into the rectangularly shaped fuel supply channels 22*c*′ formed in the top wall 22*c* of the second insert. At the same time, a mixture of air and atomized liquid fuel is drawn into the fuel distribution channel 22*a*′ formed in the lower insert and distributed equally to the fuel supply slots 22*c*′**.

The air drawn through the openings **18*a* formed in the upper insert impinges upon and reduces the atomized fuel that accumulates in the fuel supply slots 22*c*′ into a thin film of atomized liquid fuel. The thin film of atomized liquid fuel is forced out of the fuel supply slots and into the area of highest air speed, i.e., the opening between the bottom wall of the upper insert 18 and the depression 22*c*″ and the sloping wall 22*c*‴ of the second insert. Here, complete atomization of the liquid fuel takes place. It is believed by the applicant that the thin film of atomized liquid fuel forced out of the suel supply channels 22*c*′ and onto the depression 22*c*″ and the sloping wall 22*c*‴** is in the configuration of an open cone with equal amounts of fuel being supplied uniformly from each of the channels into the main body of the carburetor.

Figures 2, 2A, 5:
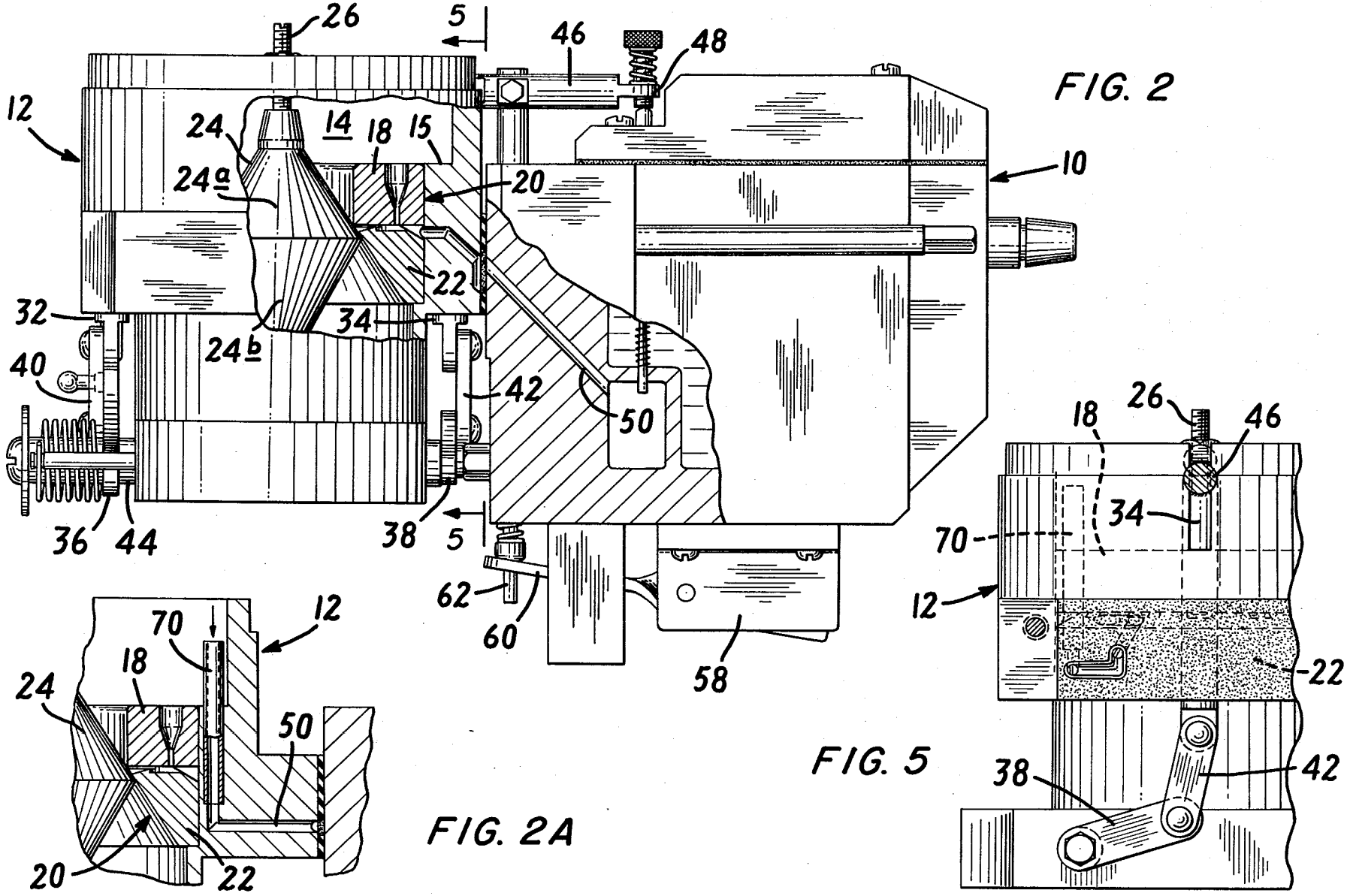
FIG. 2 is a side view, partly broken away, of the carburetor shown in FIG. 1.
FIG. 2A is an enlargement of that section of FIG. 2 showing, inter alia, the connection of the variable air bleed device to the fuel supply passage of the carburetor.
FIG. 5 is a fragmentary end view, partly broken away, of the carburetor shown in FIG. 1.

As best shown in FIGS. 1 and 2, a regulating member 24 is mounted for longitudinal movement within the housing 12. The member is in the configuration of two generally frusto-conical sections **24*a* and 24*b*, with the bases of the two sections arranged end-to-end. The diameter of the base of the regulating member 24 is slightly greater than the opening of minimum housing diameter formed by the upper and lower inserts 18 and 22. The upper section 24*a* is longer in length than the lower section 24*b* and, as measured from its apex, has a taper angle which is smaller than the taper angle of the lower section, but the same as the angle of divergence of the conically shaped interior wall 22*b* of the lower insert. The taper angle of the upper section is preferably 32°, but may range from 30° to 34°, and the taper angle of the lower section is preferably 42°, but may range from 38° to 46°. As best shown in FIGS. 1 and 2, the upper section 24*a* of the regulating member and the diverging interior wall 22*b*** of the lower insert define a constricted zone wherein atomization of the liquid fuel is completed.

The lower section **24*b*** of the regulating member provides, together with the wall of the housing, a relatively large area (expansion zone) where the atomized liquid fuel-air mixture is subjected to turbulence so as to create further admixing of the intake air and the atomized liquid fuel and provide better distribution.

The location of the regulating member 24 within the housing 12, and the configurations of the inserts 18 and 22 and the regulating member 24 are such that when the engine is shut-off, the upper section **24*a* of the regulating member extends into the air inlet section 14 and bears against the interior wall 22*b* of the lower insert 22** to preclude atomized liquid fuel from passing into the interior of the housing 12 and preclude air from flowing through the housing when the engine is inoperative.

With the engine operative, the upper section 24a of the regulating member and the diverging wall 22b of the lower insert form a constricted zone into which the intake air sweeping through the housing draws the atomized liquid fuel from the fuel atomization and distribution device 20 formed by the two inserts. The inlet opening of the constricted zone is located at the inside end of the tapered section 22c''' of the top wall of the second insert 22, while the outlet opening of the constricted zone is located at the base of the regulating member 24. As it is drawn through the constricted zone, the atomized liquid fuel is completely atomized by the air and becomes entrained therein. The result is the formation in the constricted zone of a generally uniform mixture of air and atomized liquid fuel.

A control means is provided. It includes a pin 26 which extends through the center of the housing 12 and rotatably supports the regulating member 24. A spring 28 is mounted within the lower section 24b of the regulating member 24 and constantly urges the regulating member upwardly, providing approximately 4 millimeters of "play" along the pin at open throttle. The spring compensates for changes in vacuum during fast acceleration, limiting initially the amount of air passing into and through the constricted zone in relation to the amount of liquid fuel also being supplied into the constricted zone to obtain thereby a richer mixture of air and atomized liquid fuel.

Figures 3, 4, 6, 7:
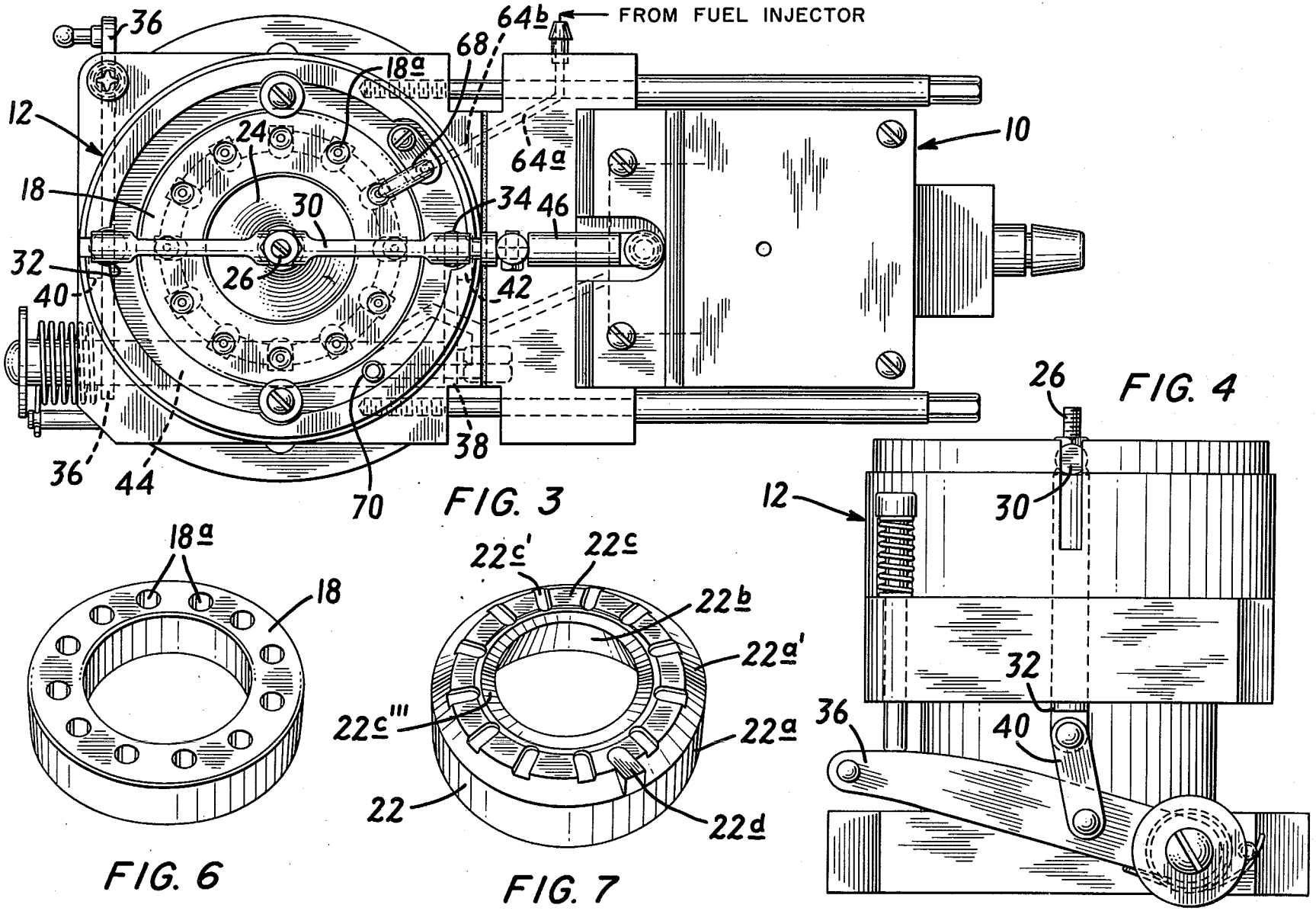
FIG. 3 is a top plan view of the carburetor shown in FIG. 1.
FIG. 4 is an end view of the carburetor of FIG. 1.
FIGS. 6 and 7 are perspective views illustrating the upper and lower inserts composing the fuel atomization and distribution device mounted in the carburetor of FIG. 1.

The pin 26 is carried by a support bar 30 (FIG. 3) which extends diametrically across the air inlet section 14 of the housing 12. The ends of the bar 30 are connected to a pair of rods 32 and 34 which extend downwardly across opposite sides of the housing 12 and are coupled to a pair of driving levers 36 and 38 by linkages 40 and 42, respectively. One of the linkages 40 is spring-biased (left one as viewed in FIG. 1). The levers 36 and 38 are, in turn, connected together by a shaft 44 (FIG. 1). As best shown in FIG. 4, the lever 36 is elongated and is connected in usual fashion to the gas pedal of the automobile.

With depression of the gas pedal to provide corresponding acceleration, the lever 36 is driven downwardly. The lever 36, in turn, rotates the shaft 44 with the result that the rods 32 and 34 are driven downwardly. The support bar 30 is driven downwardly and the regulating member 24 is displaced from the lower insert 22. In like manner, a decrease in pressure on the pedal causes movement of the regulating member 24 upwardly and toward the interior wall 22d of the lower insert.

The rod 34 is also connected to a linkage 46 having its other terminal end coupled to a spring-biased metering rod 48 located in the fuel reservoir 10. The metering rod 48 is arranged in the reservoir such that its tapered end engages the fuel outlet opening of the reservoir 10. The metering rod 48 operates to regulate the quantity of liquid fuel passing out of the reservoir and through the outlet opening and into a fuel supply passage 50. The taper angle of the metering rod can range from 0.1° to 6° or 7°, depending upon the fuel requirements of the engine.

As best shown in FIG. 3, the fuel supply passage 50 extends through the reservoir and through the thickened wall of the carburetor housing 12, finally terminating at the fuel distribution chanel 22a' formed in the second insert. It will be observed that the passage 50 opens tangentially into the channel 22a so as to spray the liquid fuel droplets into the channel at an angle, imparting a clockwise movement to the gas outlet.

The fuel reservoir 10 also includes a float 52 which cooperates with a float needle 54 arranged in a main fuel supply line 56 which is directly coupled to the fuel pump of the engine. The float 52 and the needle 54 regulate the fuel level in the fuel reservoir to a constant volume.

Also attached to the reservoir is an injector or accelerator fuel pump 58 which may be of the type sold by the Ford Motor Company. Its actuating arm 60 is coupled through a spring 62 to the linkage 46. The output of the injector fuel pump is coupled through passageways 64a and 64b formed in the reservoir 10 and the carburetor housing 12 and a ball check valve 66 mounted in the wall of the carburetor housing to a fuel injector 68 also mounted in the wall of the carburetor housing and having a nozzle that extends over one of the openings 18a formed in the first insert 18. By injecting into one of the air bleeds 18a, the fuel must go through the atomization process in the slot 22c' of the second insert located immediately below the particular air bleed.

The fuel injector 58 is provided to supply additional liquid fuel to the carburetor during starting and fast acceleration. Thus, the biasing of the spring 62 coupling the injector to the linkage must be such that only rapid, and not gradual, movement by the linkage 46 will actuate the injector 58 and cause additional liquid fuel to be supplied to the carburetor.

Although not shown, as a further measure to insure an adequate supply of liquid fuel to the carburetor during starting, there may be provided a solenoid-actuated valve mounted on the reservoir 10 that opens a flow path from the main bowl of the reservoir to the fuel supply passage 50 leading to the distribution channel 22a' formed in the second insert of the carburetor. The solenoid which actuates the valve may be coupled through a timer to the ignition switch of the automobile.

Figure 9:
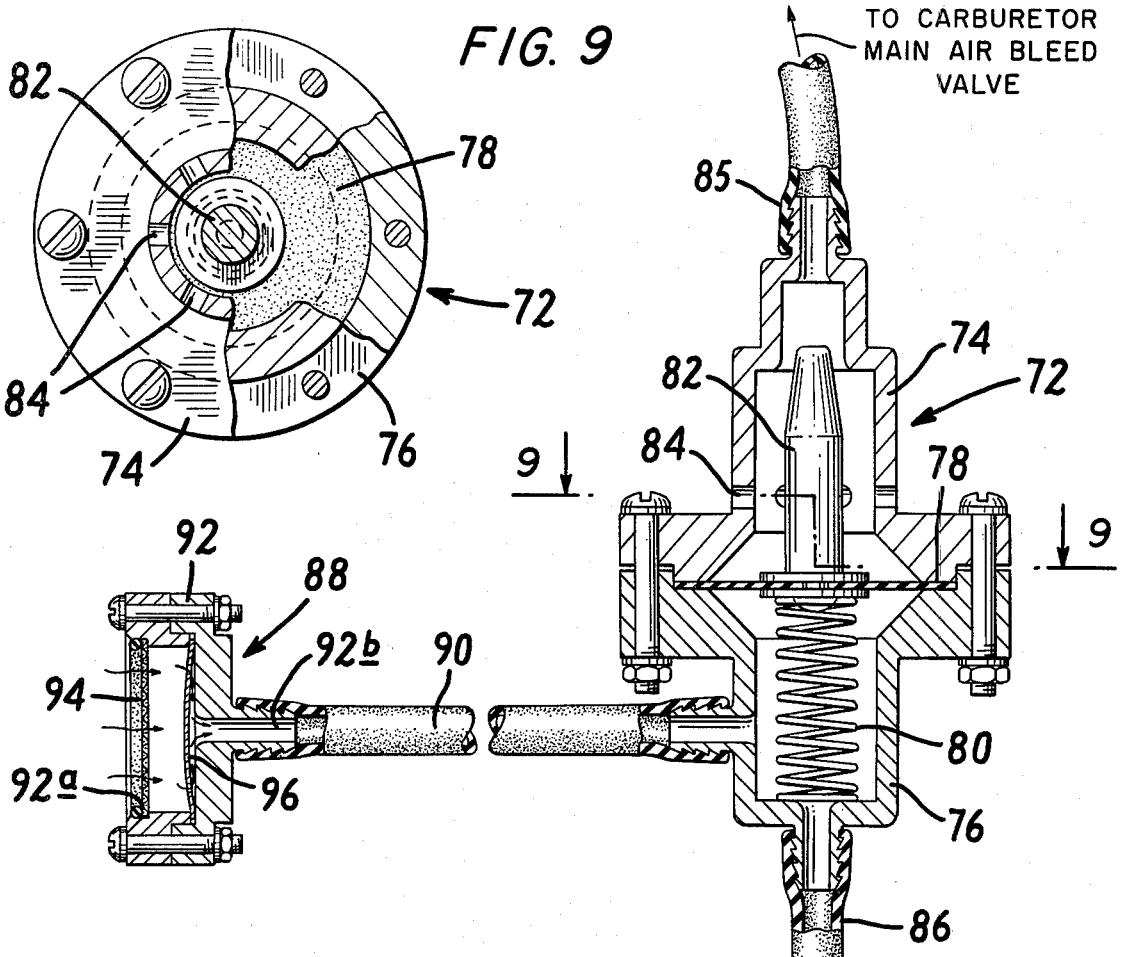
FIG. 9 is a sectional view taken along line 9-9 of FIG. 8 and looking in the direction of the arrows.
Figure 8:
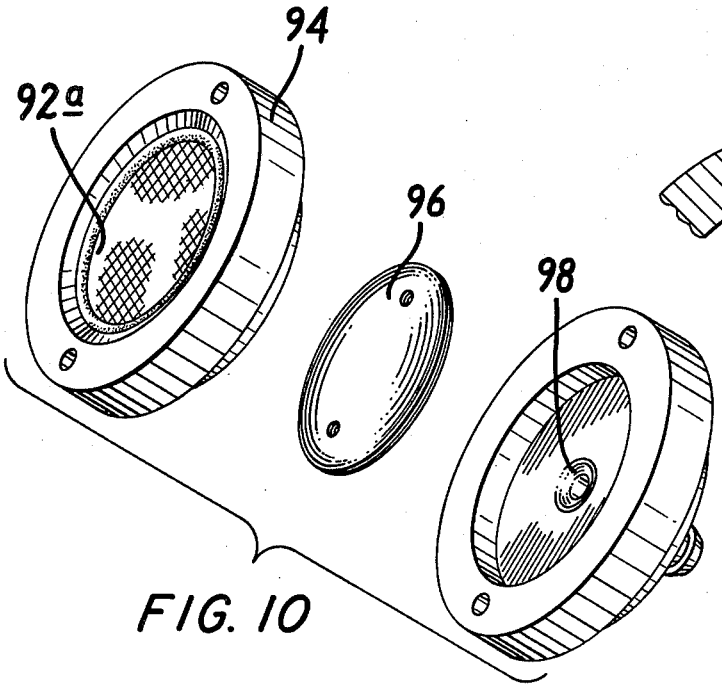
FIG. 8 is a sectional view of the variable air bleed control device used with the carburetor of FIG. 1.
Figure 10:
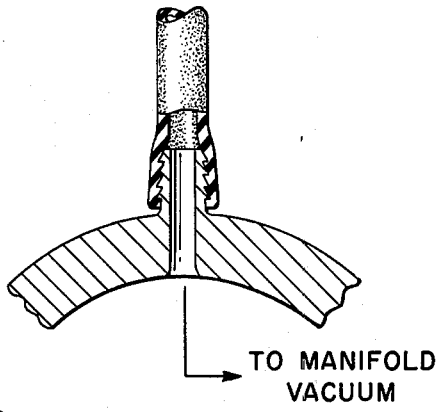
FIG. 10 is an exploded view of the temperature compensator used in conjunction with the variable air bleed control device.

As best shown in FIG. 2A and forming an integral part of this invention, there is provided a cylindrical air bleed 70 that opens at its lower end into the fuel supply passage 50. Where the fuel supply passage 50 and the air bleed 70 join together, each preferably has a diameter of 3.1 millimeters. The other end of the air bleed is connected to the variable air bleed control device 72 of the present invention, as depicted in FIGS. 8, 9 and 10. The air bleed 70 supplies air under high velocity to mix with and break-up the liquid fuel in the passage 50. This facilitates the complete atomization that later occurs in the open area between the inserts 18 and 22 and in the constricted zone defined by the regulating member 24 and the wall 22b of the insert 22.

As best shown in FIG. 8, the variable air bleed control device 72, which may be mounted next to or away from the carburetor (or may be formed as a part of the carburetor), comprises a two-part generally cylindrical housing, the upper and lower sections 74 and 76, respectively, the ends of which are coupled together by six bolts. The upper section 74 has a generally stepped cylindrical configuration so as to provide a stepped opening therein. The lower section 76 has a generally cylindrical shape so as to provide a generally cylindrical opening therein.

Mounted centrally within the housing and held in position between the sections 74 and 76 is a rubber diaphragm 78. A spring 80 mounted in the bottom part of the housing biases the diaphragm 70 upwardly. A valve 82 is mounted on the upper surface of the diaphragm and extends into the stepped opening formed in the upper section 74. The wall of the upper section 74 of the housing also includes a number of holes 84 — in an actual embodiment 12 — that provide air passageways for the largest diameter opening in the upper section 74. The open end of the upper section 74 is coupled through a rubber air hose 85 to the cylindrical air bleed 70.

The lower section 76 of the device is coupled to the engine manifold through a rubber hose 86. It will be observed that with increasing manifold vacuum, the diaphragm 78 will be drawn down against the spring 80 to thereby lower the valve 82 and permit greater amounts of air to pass from the holes 84 into the hose 85 and to the air bleed 70 (FIG. 2A). With decreasing manifold vacuum, the diaphragm 78 will return to its fixed position and a fixed amount of air will be supplied to the air bleed 70.

With the engine cold, it is desirable to supply a richer mixture of liquid fuel and air to the carburetor. To permit the supply of such enriched mixtures at cold temperatures and despite high manifold vacuum, the applicant has devised a compensating device 88 (FIGS. 8, 10). The device 88 is coupled through a rubber hose 90 to the lower section 76 of the housing 72. The compensator comprises a generally cylindrical two-part housing 92 having inlet and outlet openings 92*a* and 92*b* within which an air filter 94 is mounted and through which air is drawn. Wedged between the two parts of the housing 92 is a bimetallic element 96 containing two holes through which air may pass. A rubber O-ring 98 is placed between the element 96 and the outlet opening 92*b* of the housing. FIG. 8 shows the positioning of the bimetallic element when the engine is cold and in that condition, air is permitted to flow from the compensator 88 into the lower section of the variable air bleed control device 72. Effectively, the compensator 88 provides an air leak that will reduce by as much as 50% the vacuum existing in the lower section of the variable air bleed control device and thereby inhibit the downward deflection of the diaphragm 78. For example, with a manifold vacuum of 14 inches, the compensator will reduce the vacuum in the variable air supply device by about 5 to 7 inches.

When heated, the bimetallic element 96 closes against the rubber O-ring 98 and, accordingly, closes an air path to the variable air bleed device 72. The bimetallic element generally is heated within about 30 to 45 seconds after the start of the engine. Preferably, the compensator 88 is mounted close to the exhaust manifold or exhaust pipe so as to provide accurate compensation in accordance with the temperature of the engine.

The carburetor of the present invention with variable air bleed control device as shown in FIGS. 1–10, was tested in May and August, 1977 and the results compared with a baseline carburetor, in this case a conventional General Motors carburetor. The results of the May tests are as follows:

| | | HC | CO | NOX | MPG |
|---|---|---|---|---|---|
| 5/8 | Cold Start Baseline | 1.32 | 8.79 | 2.14 | 15.9 |
| 5/11 | Cold Start Petermann | 0.54 | 2.68 | 3.5 | 17.65 |
| 5/9 | 505 Petermann | 0.033 | 0.108 | 5.30 | 19.355 |

-continued

| | | HC | CO | NOX | MPG |
|---|---|---|---|---|---|
| 5/10 | 505 Petermann | 0.006 | 0.0074 | 5.21 | 19.7 |
| 5/11 | Highway Baseline | 0.15 | 4.2 | 2.81 | 20 |
| 5/11 | Highway Petermann | 0.004 | 0.13 | 2.47 | 22.8 |

Drivability with the Petermann carburetor was good, and there were no stalls. For the tests with the General Motors carburetor, the car was equipped with a catalytic converter and EGR. For the tests with the Petermann carburetor, the car was equipped with a catalytic converter, but no EGR.

The results of the August tests are as follows:

| | | HC | CO | NOX | CITY MPG | HGWY MPG |
|---|---|---|---|---|---|---|
| 8/12 | Cold Start Baseline | .89 | 17.15 | 1.27 | 16.49 | |
| 8/15 | Cold Start Baseline w/o EGR | .37 | 4.99 | 3.13 | 17.30 | 24.72 |
| 8/16 | Cold Start Petermann w/o EGR | .73 | 8.98 | 2.34 | 15.89 | |
| 8/16 | Cold Start Petermann w/o EGR | .76 | 7.24 | 2.12 | 16.28 | 23.75 |
| 8/18 | Cold Start Petermann w/o EGR | .71 | 5.18 | 2.35 | 16.31 | 23.09 |

The August tests with the Petermann carburetor produced results that did not prove out as expected. Applicant believes this to have been attributable to a mechanical failure in the gas supply system and not representative of the superior performance, such as the carburetor's performance in May, 1977 that his carburetor provides.

Further CVS tests were conducted in October and November at E G & G, Automotive Research, Inc., San Antonio, Texas. A standard General Motors stock carburetor which EGR and factory spark timing gave the following results:

| | HC | CO | NOX | MPG |
|---|---|---|---|---|
| 10/19/77 | .28 | 7.38 | | 16.80 |
| 10/20/77 | .25 | 7.67 | | 17.73 |
| 10/21/77 | .33 | 10.60 | | 17.82 |

The carburetor of this invention, without EGR, gave these results:

| | HC | CO | NOX | MPG |
|---|---|---|---|---|
| 10/25/77 | .05 | .31 | | 19.34 |
| 10/26 | | | | |
| 10/27 | .05 | .98 | | 17.90 |
| 10/28 | .06 | .97 | | 18.32 |
| 11/2 | .05 | .45 | | 18.12 |
| 11/3 | .05 | .66 | | 18.44 |
| 11/4 | .04 | .47 | | 18.63 |
| 11/7 | .03 | .26 | | 18.51 |

Still further tests were conducted on the carburetor of this invention during the week of Nov. 14, 1977.

In a highway fuel economy test, these results were obtained:

| HC | CO | NOX | MPG |
|---|---|---|---|
| .033 | 0.415 | 2.565 | 23.33 |

In cold start CVS tests, these results were obtained:

| HC | CO | NOX | MPG |
|---|---|---|---|
| .67 | 4.4 | 1.74 | 16.3 |
| 1.02 | 7.9 | 2.0 | 15.6 |

In these tests, stalls or stumbles occurred on sudden throttle opening.

In comparison, CVS tests on stock General Motors carburetor, with EGR, yielded these results:

| HC | CO | NOX | MPG |
|---|---|---|---|
| .68 | 10.82 | .83 | 15.023 |
| .52 | 3.14 | 1.47 | 17.6 |

Although the invention has been described herein with reference to a specific embodiment, many modifications and variations therein will readily be apparent to those skilled in the art. Accordingly, all such variations and modifications are included within the intended scope of the invention as defined by the following claims.

I claim:

1. A carburetor for internal combustion engines comprising a generally cylindrical housing having an intake air receiving section in the form of an opening of predetermined diameter and length, a mixing chamber in the form of an opening smaller in diameter than the intake air receiving section, and an outlet section, means for supplying liquid fuel to the mixing chamber, fuel atomization and distribution means in said mixing chamber, said means comprising upper and lower ring-shaped sections that define an opening of minimum diameter within the housing, the upper section having formed therethrough a plurality of circumferentially-spaced openings which function as air bleeds and the lower section having (1) an annular outside wall that communicates with the liquid fuel supply means and constitutes a fuel distribution channel, (2) a generally concially shaped interior wall, and (3) an upper wall having formed therein a plurality of fuel supply channels communicating with the fuel distribution channel and corresponding in number to the air bleed openings formed in the upper section and aligned with said openings, and a regulating member mounted for reciprocating movement within at least the mixing chamber, said regulating member having an upper section of generally frusto-conical shape with a concial angle substantially the same as the conical angle of the interior wall of the lower section of the fuel atomization and distribution means and forming therewith a constricted zone wherein atomization of the liquid fuel supplied from the fuel atomization and distribution means to the constricted zone takes place.

2. A carburetor according to claim 1 further comprising a variable air bleed control means coupled to the liquid fuel supply means for supplying a variable amount of air to the liquid fuel supply means for mixing with and breaking-up of the liquid fuel in the fuel supply means.

3. A carburetor according to claim 1 wherein the regulating member is in the configuration of two generally frusto-conical sections with the bases of the two sections arranged end-to-end and the lower section provides, within the outlet section of the housing, an expansion area through which the atomized liquid fuel-air mixture passes.

4. A carburetor according to claim 3 wherein the taper angle of the concially shaped interior wall of the lower section of the fuel atomization and distribution means and the taper angle of the upper section of the regulating member ranges between 30° and 34°.

5. A carburetor according to claim 1 wherein the upper wall of the lower section of the fuel distribution and atomization means further comprises an annular depression formed therein adjacent the inside ends of the fuel supply channels and a sloping wall that extends downwardly from the annular depression to the concially shaped interior wall, the depression and sloping wall providing an opening between the upper and lower sections of the fuel atomization and distribution means wherein air drawn through the carburetor mixes with and atomizes the already atomized fuel supplied to the fuel supply channels.

6. A carburetor according to claim 5 wherein each of the openings formed in the upper section of the fuel atomization and distribution means includes a first cylindrical section having a predetermined diameter and through which the intake air first passes, a second tapered section and a second cylindrical section having a diameter which is a fraction of the diameter of the first cylindrical section and through which the intake air exits to impinge upon the atomized liquid fuel present in the fuel supply channels formed in the upper wall of the second section.

7. A carburetor according to claim 2 wherein the liquid fuel supply means comprises a passage formed in the wall of the housing and wherein the variable air bleed control means comprises a hollow rod having a diameter equal to the diameter of the fuel passage and means responsive to changes in manifold vacuum for supplying air to the hollow rod in accordance with manifold vacuum.

8. A carburetor according to claim 7, wherein the means responsive to manifold vacuum comprises an open-ended two part housing, the upper part of which is connected to the hollow rod and has a generally stepped cylindrical configuration so as to provide a stepped opening therein and the lower part of which is connected to the manifold of the engine, means forming openings in the upper part of the housing through which air passes, a spring biased diaphragm mounted centrally within the housing, and a valve mounted on the upper surface of the diaphragm and extending into the stepped opening of the upper part for controlling the amount of air that passes from the openings to the hollow rod in accordance with its positioning as controlled by manifold vacuum.

9. A carburetor according to claim 8 further comprising compensating means for said variable air bleed control means, said compensator means comprising an air passage between the compensating means and the lower part of the housing of the manifold vacuum responsive means, air supply means and a bimetallic element responsive to changes in temperature to couple the air supply means to the air passage when the engine is cold and thereby reduce the vacuum in the lower part of the housing and block the air supply means when the temperature of the engine exceeds a predetermined level.

* * * * *